United States Patent [19]

Geller et al.

[11] 4,272,762

[45] Jun. 9, 1981

[54] EXIT-ENTRY SENSING APPARATUS

[75] Inventors: William L. Geller; Richard L. Naugle, both of Framingham, Mass.

[73] Assignee: GTE Laboratories Incorporated, Waltham, Mass.

[21] Appl. No.: 75,769

[22] Filed: Sep. 17, 1979

[51] Int. Cl.[3] ..... G08B 13/18

[52] U.S. Cl. ..... 340/556; 250/221; 340/523

[58] Field of Search ..... 340/523, 526, 555, 556, 340/557; 250/221, 222 R

[56] References Cited

U.S. PATENT DOCUMENTS

| | | | |
|---|---|---|---|
| 2,455,909 | 12/1948 | Smith | 340/556 X |
| 2,595,993 | 5/1952 | Templeman et al. | 340/556 X |
| 3,524,180 | 8/1970 | Cruse | 340/523 |
| 3,789,384 | 1/1974 | Akers | 250/221 X |
| 3,825,916 | 7/1974 | Steele et al. | 340/557 |
| 3,914,753 | 10/1975 | Cho | 340/556 X |
| 4,009,389 | 2/1977 | Lindholm | 340/555 X |

*Primary Examiner*—John W. Caldwell, Sr.
*Assistant Examiner*—Joseph E. Nowicki
*Attorney, Agent, or Firm*—David M. Keay

[57] ABSTRACT

Sensing apparatus for monitoring the passage of objects, including people, through a doorway. A source of radiant energy is positioned at one side of the doorway and two spaced-apart detectors are positioned at the opposite side to receive beams of radiant energy from the source. A receiver is connected to each detector and produces a signal indicating whether the beam of radiation from the source is impinging on its associated detector or is being blocked by a passing object. Logic circuitry responds to the signals from the receivers and produces a first or second output condition depending upon which beam from the source is the last one to be interrupted by a passing object. Output circuitry coupled to the logic circuitry produces a pulse at one output terminal on a transition from the first to the second output condition indicating passage of an object through the doorway in one direction and produces a pulse at another output terminal on a transition from the second to the first output condition indicating passage of an object through the doorway in the opposite direction.

9 Claims, 3 Drawing Figures

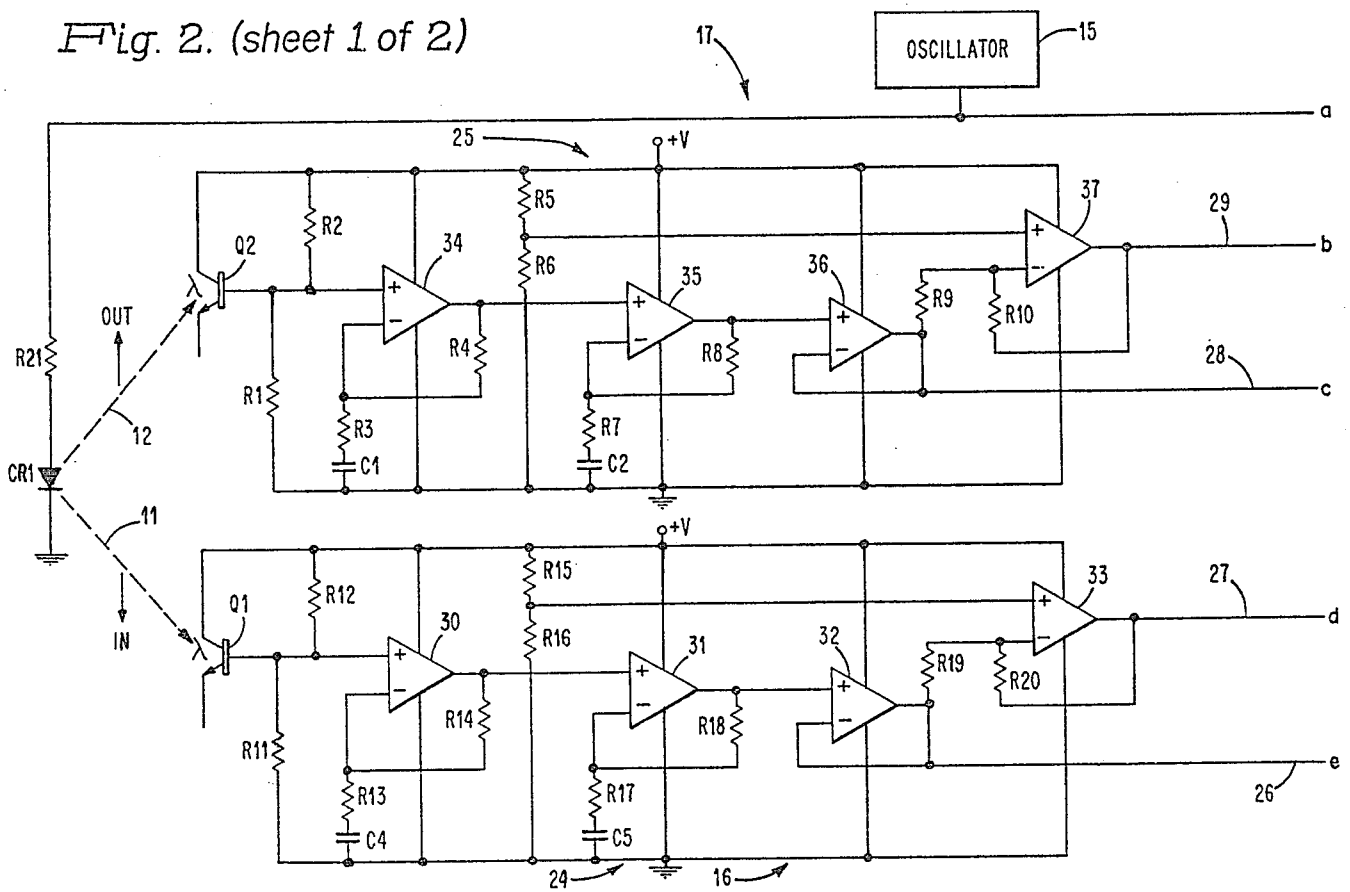
Fig. 2. (sheet 1 of 2)

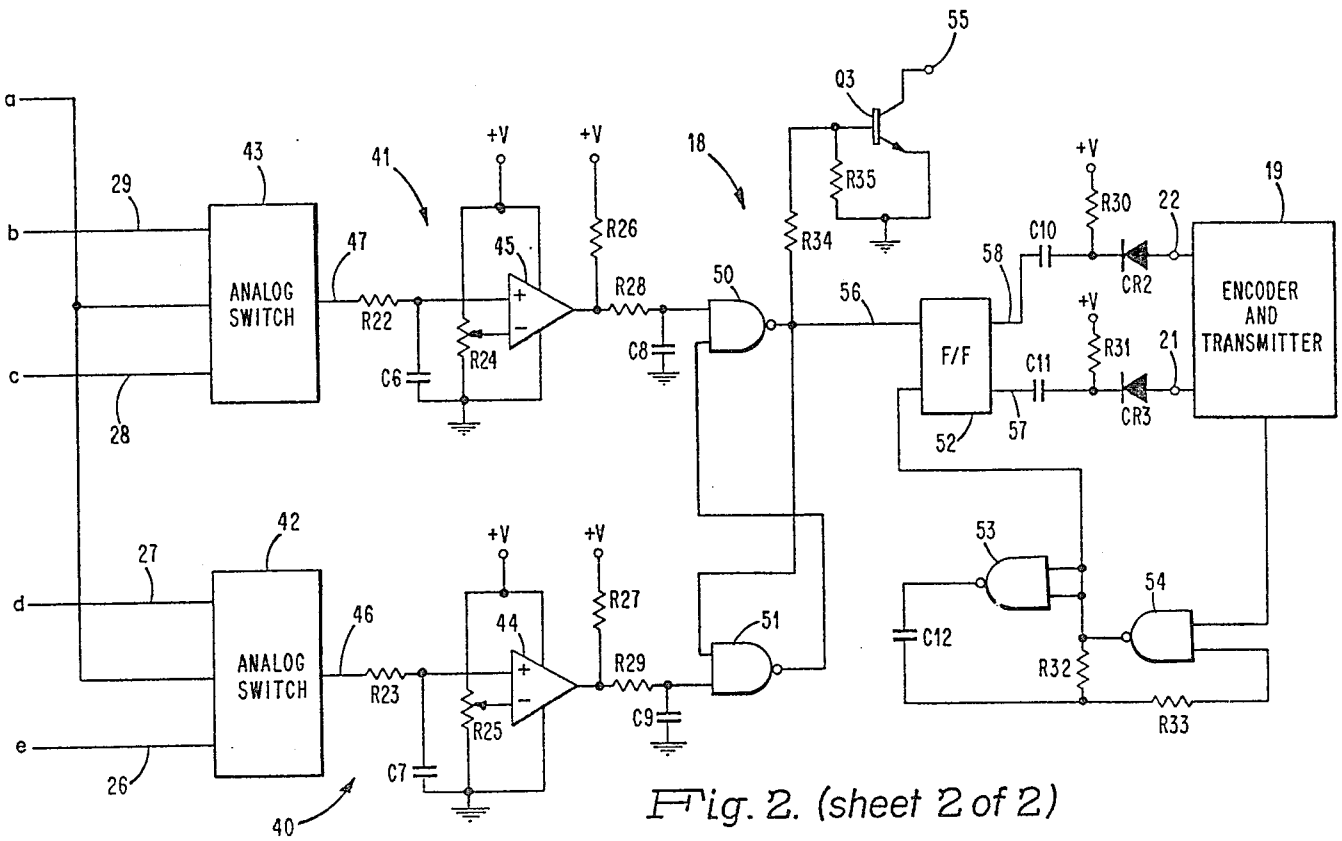
Fig. 2. (sheet 2 of 2)

EXIT-ENTRY SENSING APPARATUS

BACKGROUND OF THE INVENTION

This invention relates to sensing apparatus. More particularly, it is concerned with sensing apparatus for monitoring the passage of objects through a doorway or portal.

In certain situations it is desirable to determine when an object, for example a person, passes through a doorway and the direction of movement through the doorway. Such determination may be useful in systems for passively monitoring activities of persons, particularly elderly persons. One passive monitoring system is described in U.S. Pat. No. 3,885,235. This system monitors the occurrence of certain routine activities and provides appropriate indications in the event that such routine activities do not occur within a preselected period of time.

The passage of persons through a doorway into and out of a room may be monitored to determine the routine activities within a dwelling unit. In particular, it may be desirable to monitor the passage of persons into and out of a bathroom, since a high percentage of home accidents occur within the bathroom. Various types of apparatus have been employed to detect the passage of a person through a doorway, and to determine the direction of movement such that an indication can be provided that a person has entered and/or has vacated a room.

SUMMARY OF THE INVENTION

The present invention provides an improved sensing apparatus for monitoring the passage of objects through a doorway or portal and for determining the direction of movement of the object. Sensing apparatus in accordance with the present invention includes a source of radiant energy mounted at one side of the portal to be monitored. First and second radiant energy detectors are mounted at the opposite side of the portal so as to receive first and second beams of radiant energy, respectively, directed across the portal from the source of radiant energy. The detectors are spaced apart in the direction objects move through the portal so that an object passing through the portal in one direction interrupts the first beam of radiant energy and then the second beam, and an object passing through the portal in the opposite direction interrupts the second beam of radiant energy and then the first beam. Each of the radiant energy detectors produces a first signal condition when it is receiving radiant energy from the source and produces a second signal condition when it is not receiving radiant energy from the source.

A first receiver means is coupled to the first radiant energy detector and produces a first output condition in response to a first signal condition from the first radiant energy detector and produces a second output condition in response to a second signal condition from the first radiant energy detector. A second receiver means is coupled to the second radiant energy detector and produces a first output condition in response to a first signal condition from the second radiant energy detector and produces a second output condition in response to a second signal condition from the second radiant energy detector.

The first and second receiver means are coupled to a logic means which has first and second operating states. The logic means becomes switched to the first operating state in response to the output condition from the first receiver means changing from the first to the second output condition. The logic means becomes switched to the second operating state in response to the output condition from said second receiver means changing from the first to the second output condition. Thus, passage of an object through the portal in the one direction causes the logic means to operate in the second operating state and passage of an object through the portal in the opposite direction causes the logic means to operate in the first operating state.

BRIEF DESCRIPTION OF THE DRAWINGS

In the drawings:

FIG. 2 is a detailed schematic circuit diagram of the sensing apparatus illustrated in FIG. 1.

For a better understanding of the present invention, together with other and further objects, advantages, and capabilities thereof, reference is made to the following discussion and appended claims in connection with the above described drawings.

DETAILED DESCRIPTION OF THE INVENTION

Figure 1:
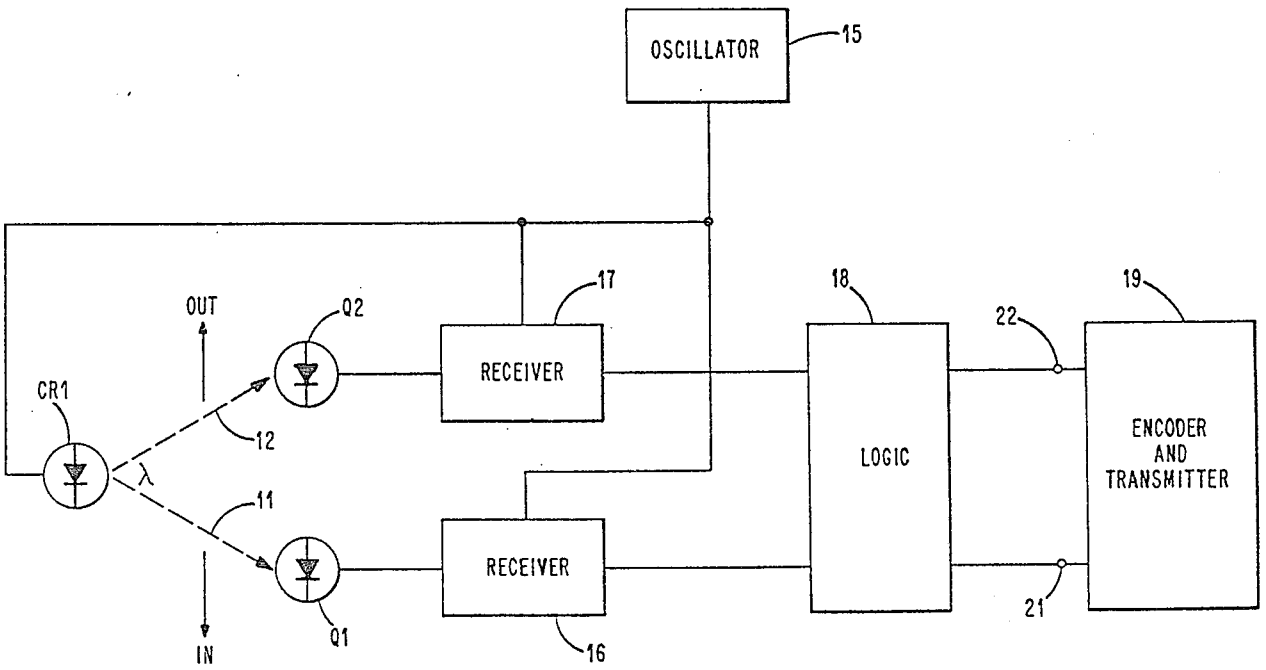
FIG. 1 is a block diagram of sensing apparatus in accordance with the present invention.

FIG. 1 is a block diagram of sensing apparatus in accordance with the present invention. The apparatus includes an infra-red emitting diode CR1 which is located at one side of a portal such as a doorway to a room. Two infra-red detectors Q1 and Q2 are mounted on the opposite side of the doorway. Thus, two beams of infra-red radiant energy 11 and 12 pass across the doorway from the emitter CR1 to the detectors Q1 and Q2, respectively. The detectors Q1 and Q2 are spaced apart along the direction of movement of an object such as a person through the doorway into or out of the room. As indicated by the arrows and labels the inner beam is beam 11 to detector Q1 and the outer beam is beam 12 to detector Q2.

The infra-red emitter CR1 is driven by an oscillator 15. The resulting infra-red beams 11 and 12 are received by the detectors Q1 and Q2 and converted to electrical signals which are applied to receivers 16 and 17, respectively. The oscillator 15 is also connected to the receivers 16 and 17 for reasons to be explained in detail hereinbelow. The outputs of the receivers 16 and 17 are applied to logic circuitry 18. The output of the logic circuitry at output terminals 21 and 22 may be applied to an encoder and transmitter 19.

Under operating conditions infra-red emitter CR1 generates pulses of infra-red radiant energy at the frequency of the oscillator 15. Beams 11 and 12 of pulsed infra-red energy travel across the doorway, at an appropriate height so as to be interrupted by a person passing through the doorway, to the detectors Q1 and Q2, respectively. The receivers 16 and 17 suitably process the output of the detectors Q1 and Q2, respectively. When an infra-red beam is being received by its associated detector, the output of the associated receiver is high, or logic 1. When an infra-red beam is blocked by a person passing through the beam and is not being received by its associated detector, the output of the associated receiver is low, or logic 0. The outputs of the receivers are applied to the logic circuitry 18.

The logic circuitry 18 operates to produce a negative-going pulse an output terminal 22 when the output of receiver 16 is a logic 0 subsequent to the output of receiver 17 being logic 0. This event occurs when the inner beam 11 is broken subsequent to the breaking of the outer beam 12 indicating movement of an object through the doorway in the IN direction. A negative-going pulse is produced on output terminal 21 when the output of receiver 17 is a logic 0 subsequent to the output of receiver 16 being logic 0. This event occurs when the outer beam 12 is broken subsequent to the breaking of the inner beam 11 indicating movement of an object through the doorway in the OUT direction. Both output terminals 21 and 22 are connected as inputs to an encoder and transmitter 19 which transmits suitably encoded RF signals indicating the entry or exit through the doorway as will be explained hereinbelow. One form of an encoder and transmitter suitable for use with the sensing apparatus of the present invention is described in greater detail in application Ser. No. 075,783 filed concurrently herewith on Sept. 17, 1979 by Jeffrey R. Fox, Arthur Margolies, and Rob Moolenbeek entitled "Electrical Power Supply Apparatus" and assigned to the assignee of the present application.

Figure 3:
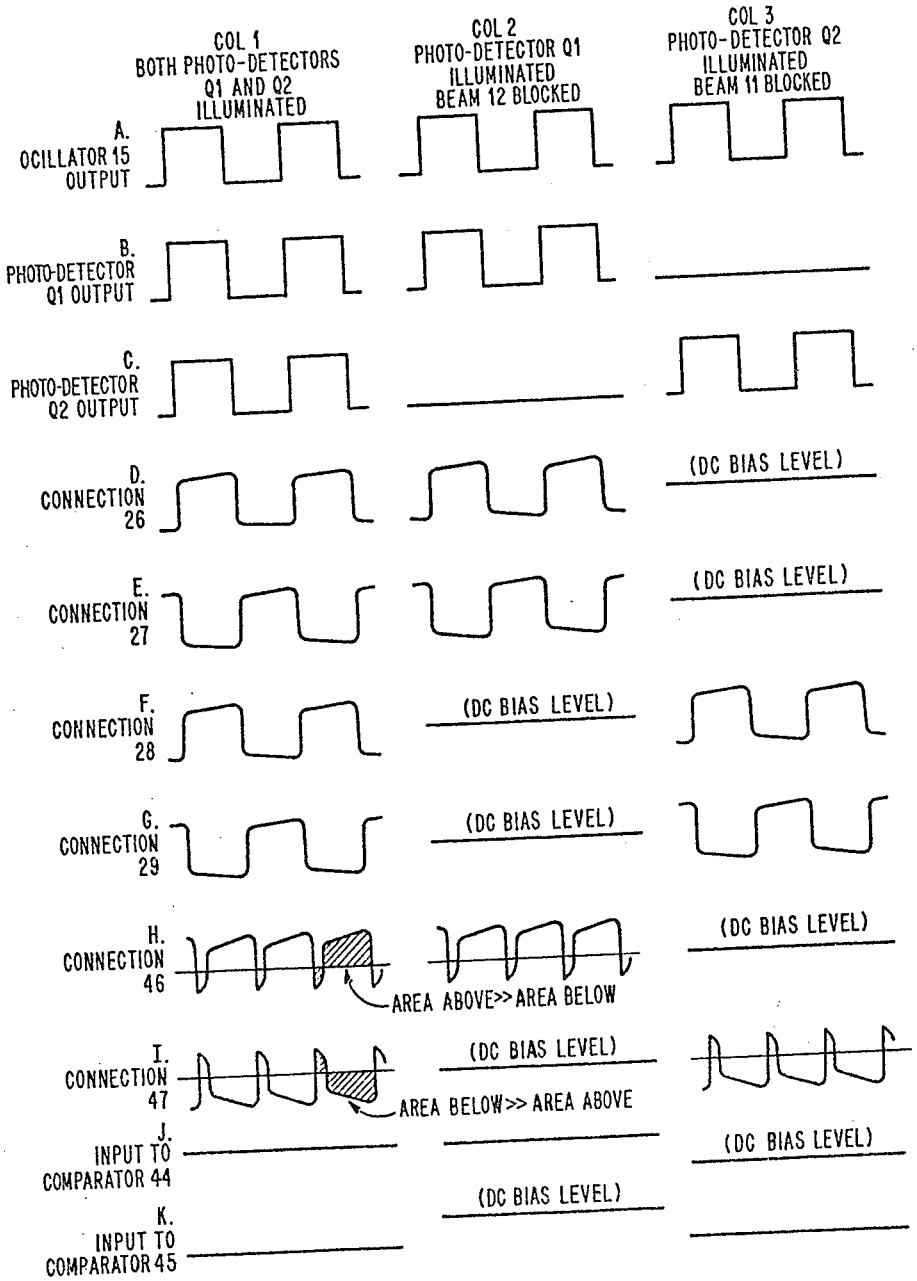
FIG. 3 are sets of curves illustrating voltage waveforms at various points of the circuit of FIG. 2 under various operating conditions.

FIG. 2 is a detailed schematic diagram of sensing apparatus in accordance with the present invention. FIG. 3 illustrates the waveforms at different points of the apparatus of FIG. 2 when both photodetectors Q1 and Q2 are illuminated by beams 11 and 12, respectively (column 1), when beam 12 is blocked (column 2) and when beam 11 is blocked (column 3). The infra-red emitting diode CR1 is mounted at one side of the doorway to be monitored and is driven by a squarewave oscillator 15 which operates at approximately 2.5 KHz (FIG. 3A). Resistance 21 is a current limiting resistance. The two infra-red detectors Q1 and Q2 in one specific embodiment are phototransistors arranged so that the collector-base junctions serve as inputs to the receivers 16 and 17, respectively, thus providing a more linear response. The outputs of the photodetectors Q1 and Q2 are shown in FIGS. 3B and C, respectively.

The first sections 24 and 25 of the receivers 16 and 17 amplify and filter the signals produced by the phototransistors and produce noninverted and inverted output signals at connections 26 and 27, and 28 and 29, respectively, (FIGS. 3D, E, F, and G). Each of these sections 24 and 25 is identical. In section 25 the output of phototransistor Q2 is applied to the noninverting input of amplifier 34. Resistances R1 and R2, which are of equal resistance, form a voltage divider providing a reference voltage to this input. Amplifier 34 together with resistances R3 and R4 and capacitance C1 provides an active high pass filter. Amplifier 35 and its associated passive components resistances R7 and R8 and capacitance C2 provides a second active filter with similar gain versus frequency characteristics. The combination of the two amplifiers in cascade provides a frequency selective amplification process at the desired frequency of 2.5 KHz.

Amplifier 36 operates as a unity gain buffer. The output from amplifier 36 appears at connection 28 and is applied to the inverting input of an amplifier 37. A reference voltage from the voltage divider of resistances R5 and R6, which are of equal resistance, is applied to the noninverting input. Amplifier 37 serves as an inverting unity gain buffer and provides at connection 29 an output which is inverted about the DC bias level with respect to the output at connection 28. When there is no signal from the phototransistor Q2 (beam 12 blocked), the outputs at connections 28 and 29 are a DC bias level established by the voltage dividers R1–R2 and R5–R6, respectively. (FIGS. 3F and G, column 2.) In one specific embodiment for example, the DC bias level is approximately 4.0 volts.

The amplifiers 30, 31, 32, and 33 and the associated components in section 24 are identical to the corresponding elements in section 25. The signal produced at connection 27 is inverted about the DC bias level with respect to that produced at connection 26. (FIGS. 3D and E.)

The output connections 26 and 27 of section 24 and the output connections 28 and 29 of section 25 are connected to synchronous detectors 40 and 41, respectively. Connections 26 and 27 are connected to the inputs of an analog switch 42, and output connections 28 and 29 are connected to the inputs of another analog switch 43. The analog switches 42 and 43 are driven by the squarewave output pulses from the oscillator 15 and, therefore, are synchronized with the output pulses from the sections 24 and 25. (See FIG. 3.) When the level of the control signal from the oscillator 15 to analog switch 42 is high, the signal on connection 26 is switched to its output 46; and when the control is low, the signal on connection 27 is switched to the output 46. When the control signal to the other analog switch 43 is high, the signal on connection 29 is switched to its output 47; and when the control signal is low, the signal on connection 28 is switched to the output 47. FIGS. 3H and I illustrate the resulting waveforms which would be produced at the outputs 46 and 47 of the analog switches 42 and 43, respectively, except for the presence of integrating circuitry as will be explained.

The output of analog switch 42 is applied to an integrating network of resistance R23 and capacitance C7 having a time constant of about 30 milliseconds. The resulting filtered signal as illustrated by FIG. 3J is applied to the noninverting input of a comparator 44. In the specific embodiment the voltage at the comparator input is 5.0 to 5.5 volts when the photodetector Q1 is illuminated by beam 11. (FIG. 3J, column 2.) When the beam 11 is broken and photodetector Q1 is not illuminated, the input voltage is the DC bias level, approximately 4.0 volts. (FIG. 3J, column 3.) The wiper connection to resistance R25 is adjusted to provide a reference voltage at the inverting input to comparator 44 intermediate these two voltages. In the specific embodiment under discussion the reference voltage is set at 4.4 volts. The comparator 44 produces a relatively high output voltage, logic 1, when the voltage at its noninverting input is greater than the reference voltage (photodetector Q1 illuminated), and produces a relatively low output voltage, logic 0, when the voltage at its noninverting input is less than the reference voltage (beam 11 to photodetector Q1 broken).

The other analog switch 43 is connected to an integrating network of resistance R22 and capacitance C6 also having a time constant of about 30 milliseconds. The smoothed output as illustrated by FIG. 3K is applied to the inverting input of a comparator 45. The noninverting input is connected to the wiper of a resistance R24 and is adjusted to provide a reference voltage of approximately 3.6 volts. This voltage is above that produced at the inverting input when the photodetector Q2 is receiving radiation (FIG. 3K, columns 1 and 3)

and below the DC bias level of 4.0 volts produced when beam 12 is broken (FIG. 3K, column 2). Thus, the output of comparator 45 is relatively high, logic 1, when beam 12 is being received by photodetector Q2 and is relatively low, logic 0, when beam 12 is intercepted.

The receivers 16 and 17 together with the 2.5 KHz pulses of infra-red radiation from the emitter CR1 prevent the presence of ambient light and other radiation in the environment from falsely indicating that a beam 11 or 12 is impinging on the associated photodetector Q1 or Q2, respectively, when actually the beam is blocked. The strong DC and low frequency effects of sunlight, electric lights, and TV radiation are prevented from saturating the receiver circuitry by the resistances at the inputs to the first amplifier stages. The dual two stage amplifier of the first sections 24 and 25 are frequency selective and greatly enhance the desired 2.5 KHz signals with respect to unwanted signals and noise. The two synchronous detectors 40 and 41, which are driven at 2.5 KHz, permit only signals close to 2.5 KHz (±100 Hz) to add to, or substract from, the DC bias level of 4.0 volts. Frequencies above and below 2.5 KHz produce at the outputs 46 and 47 of the analog switches 42 and 43 voltage waveforms which are above and below the DC bias level by amounts which average the DC bias level. When these signals are filtered they produce the DC bias level at the input to the comparators 44 and 45. Thus, the receiver discriminates between the 2.5 KHz signals from the infra-red emitter and the DC and low frequency ambient noise, particularly at 60 and 120 Hz, present in the environment.

The outputs of the comparators 44 and 45 are applied by way of resistance-capacitance networks to two NAND gates 50 and 51 which are cross-connected to form a flip-flop. The output of the flip-flop at connection 56 is either a relatively high voltage, logic 1, or a relatively low voltage, logic 0, depending upon which comparator 45 or 44 was the last to produce a logic 0 in response to the beam to its associated photodetector Q2 or Q1 being intercepted. The output signal produced by the state of the flip-flop 50–51 is communicated by an arrangement of resistances R34 and R35 and a transistor Q3 to an output terminal 55.

The output connection 56 is also connected as the data input to a D-type flip-flop 52. The other input to the D-type flip-flop 52 is a clock pulse from a clock pulse generator including NAND gates 53 and 54, resistances R32 and R33, and a capacitance C12. A change in the data at the connection 56 is clocked into the flip-flop 52 on the next succeeding clock pulse from the clock pulse generator. When the input to the flip-flop 52 changes from a logic 1 to a logic 0, the voltage at output 58 goes low and the arrangement of capacitance C10, resistance R30, and diode CR2 causes a momentary negative-going pulse to occur at output terminal 22. When the input to flip-flop 52 goes from a logic 0 to a logic 1, the voltage at output 57 goes low and the arrangement of capacitance C11, resistance R31, and diode CR3 causes a momentary negative-going pulse to occur at output terminal 21. Suitable paths to ground for terminals 21 and 22 are provided within the encoder and transmitter 19.

The encoder and transmitter 19 receives the negative-going pulses on terminals 21 and 22 and in response thereto transmits an appropriately encoded RF signal. The clock generator may be controlled by the encoder and transmitter 19 so that during RF transmission the input to NAND gate 54 is grounded and no clock pulses are generated. Thus, data produced by the flip-flop 50–51 at connection 56 is not accepted by the flip-flop 52 until the transmission in process is completed. The clock generator then resumes operation and clocks the most recent data into the flip-flop 52 for encoding and transmission.

The sensing apparatus as described operates in the following manner. When both beams 11 and 12 of pulsed infra-red radiation are transmitted unobstructed to their respective photodetectors Q1 and Q2, a series of electrical pulses are produced at each of the connections 26, 27, 28 and 29 as shown in FIGS. 3D, E, F, and G, column 1, respectively. The voltage levels as shown in FIGS. 3J and K are produced at the inputs of comparators 44 and 45, respectively, and the output of each comparator is a logic 1. Assuming that the last passage made through the doorway by a person was from inside to outside, the last beam broken would be beam 12 and flip-flop 50-51 would be producing a logic 1 at connection 56. In this situation output 57 of flip-flop 52 would be low and output 58 would be high.

When a person enters the room passing through the doorway from outside to inside, the first beam broken would be beam 12. This action causes section 25 to produce the DC bias level at its outputs 28 and 29 (FIGS. 3F and G, column 2) and thus the input to comparator 45 becomes relatively high (FIG. 3K) causing its output to be a logic 0. This signal has no effect on the operating state of flip-flop 50–51, however, since, in accordance with the original assumption, the flip-flop is already set to produce a logic 1 at its output connection 56. Thus, this transient condition can be ignored since it has no effect on the flip-flops 50–51 or 52 or on the output signals at the output terminals 21 and 22.

As a person continues into the room beam 11 to photodetector Q1 is broken and beam 12 to photodetector Q2 becomes unobstructed. The resulting signals produced by sections 24 and 25 at connections 26, 27, 28, and 29 are illustrated in FIGS. 3D, E, F, and G, column 3, respectively. The input to comparator 44 becomes the DC bias level (FIG. 3J, column 3) and its output becomes a logic 0. The input to comparator 45 is low (FIG. 3K, column 3) causing its output to be a logic 1. These input conditions to flip-flop 50–51 cause it to switch operating states and its output at connection 56 becomes a logic 0. On the next clock pulse from the clock generator, the D-type flip-flop 52 enters the logic 0 at its data input changing its operating state and producing a low level at output 58. This transition causes a momentary negative-going pulse to appear at output terminal 22 causing the encoder and transmitter 19 to turn on and transmit the information in a suitable form. Upon restoration of the beam 11 illuminating photodetector Q1 conditions in the receivers 16 and 17 revert to those as shown in column 1 of FIG. 3. Flip-flop 50–51 remains in the switched operating state producing a logic 0 at connection 56. D-type flip-flop 52 also remains in its switched state producing a low voltage at output 58 and a high voltage at output 57.

Subsequently, when a person vacates the room passing from the inside to the outside through the doorway, beam 11 is interrupted first. This action has only a transient effect on receiver 16 and no effect on the operation of flip-flop 50–51. When beam 12 is broken and beam 11 restored, section 25 produces the DC bias level at connections 28 and 29 (FIGS. 3F and G, column 2). The input to comparator 45 becomes relatively high (the DC bias level) (FIG. 3K, column 2) and the output of comparator 45 becomes a logic 0. This input to flip-flop 50–51 causes it to change operating states and its output at connection 56 becomes a logic 1. On the next clock pulse from the clock generator the D-type flip-flop 52 enters this data by changing operating states. The voltage at the output 58 goes high and that at output 57 goes low. The transition to low at output 57 causes a momentary negative-going pulse to occur at output terminal 21 thereby causing the encoder and transmitter 9 to turn on and transmit an appropriate signal.

Thus, the apparatus as described operates to produce a signal when a person or other object passes through a doorway and provides an indication as to the direction of movement. The apparatus may be very small in size utilizing readily available integrated circuits for many of the circuit elements. The apparatus operates satisfactorily over a wide range of ambient conditions and has excellent immunity to noise.

While there has been shown and described what is considered to be a preferred embodiment of the present invention, it will be obvious to those skilled in the art that various changes and modifications may be made therein without departing from the invention as defined by the appended claims.

What is claimed is:

1. Sensing apparatus for monitoring the passage of objects through a portal including in combination a source of radiant energy mounted at one side of the portal;

first and second radiant energy detectors mounted at the opposite side of the portal for receiving first and second beams of radiant energy, respectively, directed across the portal from said source of radiant energy;

said radiant energy detectors being spaced apart in the direction of movement of objects through the portal so that an object passing through the portal in one direction interrupts the first beam of radiant energy and then the second beam of radiant energy and an object passing through the portal in the opposite direction interrupts the second beam of radiant energy and then the first beam of radiant energy;

said first radiant energy detector being operable to produce a first signal condition when receiving radiant energy from said source and to produce a second signal condition when not receiving radiant energy from said source;

said second radiant energy detector being operable to produce a first signal condition when receiving radiant energy from said source and to produce a second signal condition when not receiving radiant energy from said source;

first receiver means coupled to said first radiant energy detector for producing a first output condition in response to the first signal condition from the first radiant energy detector and a second output condition in response to the second signal condition from the first radiant energy detector;

second receiver means coupled to said second radiant energy detector for producing a first output condition in response to the first signal condition from the second radiant energy detector and a second output condition in response to the second signal condition from the second radiant energy detector;

logic means coupled to the first and second receiver means and having first and second operating states, said logic means being switched to said first operating state in response to the output condition from said first receiver means changing from the first to the second output condition while the second receiver means is producing its first output condition and being switched to said second operating state in response to the output condition from said second receiver means changing from the first to the second output condition while the first receiver means is producing its first output condition;

whereby passage of an object through the portal in the one direction causes the logic means to operate in said second operating state and passage of an object through the portal in the opposite direction causes the logic means to operate in said first operating state.

2. Sensing apparatus in accordance with claim 1 including output means coupled to said logic means and operable to produce a momentary signal at a first output terminal in response to said logic means switching from said second operating state to said first operating state and operable to produce a momentary signal at a second output terminal in response to said logic means switching from said first operating state to said second operating state whereby passage of an object through the portal in the one direction causes the output means to produce a momentary signal at said second output terminal and passage of an object through the portal in the opposite direction causes the output means to produce a momentary signal at said first output terminal.

3. Sensing apparatus in accordance with claim 2 wherein said logic means includes first bistable means connected to the first and second receiver means and having first and second output conditions, said first bistable means being set to produce said first output condition in response to said first receiver means producing said second output condition while the second receiver means is producing its first output condition and being set to produce said second output condition in response to said second receiver means producing said second condition while the first receiver means is producing its first output condition; and second bistable means connected to the first bistable means and operable to be switched to a first operating state in response to a clock pulse when the first bistable means is producing the first output condition and operable to be switched to a second operating state in response to a clock pulse when the first bistable means is producing the second output condition whereby passage of an object through the portal in the one direction causes the second bistable means to be switched to its second operating state in response to a clock pulse and passage of an object through the portal in the opposite direction causes the second bistable means to be switched to its first operating state in response to a clock pulse.

4. Sensing apparatus in accordance with claim 1 wherein said source of radiant energy produces first and second beams of radiant energy which are series of pulses of radiant energy;

said first radiant energy detector produces a first signal which is a series of electrical pulses in response to receiving a series of pulses of radiant energy from said source of radiant energy; and said second radiant energy detector produces a first signal which is a series of electrical pulses in response to receiving a series of pulses of radiant energy from said source of radiant energy.

5. Sensing apparatus in accordance with claim 4 including oscillator means coupled to said source of radiant energy for causing said source to produce pulses of radiant energy at a predetermined frequency; and wherein each of said radiant energy detectors produces a series of electrical pulses at said predetermined frequency in response to receiving pulses of radiant energy at said predetermined frequency from said source; and each of said receiver means includes circuit means coupled to the associated radiant energy detector and operable to produce an inverted and a non-inverted series of electrical pulses at said predetermined frequency when the associated detector is producing a series of electrical pulses at said predetermined frequency, and synchronous detector means coupled to the circuit means and to said oscillator means and operable to produce a first output condition of a first voltage when the circuit means is producing said inverted and non-inverted series of electrical pulses and to produce a second output condition of a second voltage when the circuit means is not producing said inverted and non-inverted series of electrical pulses.

6. Sensing apparatus in accordance with claim 5 wherein each of said circuit means includes amplifying and filtering means coupled to the associated radiant energy detector for selectively amplifying the series of electrical pulses at said predetermined frequency produced by the associated radiant energy detector;

first buffer means having its input coupled to the amplifying and filtering means for producing a series of electrical pulses at its output in response to the series of electrical pulses applied at its input; and second buffer means having its input coupled to the output of said first buffer means for producing a series of electrical pulses at its output which are inverted with respect to the series of electrical pulses applied at its input;

whereby a first series of electrical pulses at said predetermined frequency and a second series of electrical pulses at said predetermined frequency inverted with respect to the pulses of the first series are produced at the outputs of the first and second buffer means, respectively.

7. Sensing apparatus in accordance with claim 6 wherein said oscillator means is operable to produce square-wave pulses at said predetermined frequency, the pulses alternating between a first and a second voltage level;

the synchronous detector means of one of said receiver means includes switching means coupled to the oscillator means and having first and second inputs connected to the outputs of the first and second buffer means of the circuit means of said one of said receiver means, said switching means being operable to switch the signal at the first input to its output when a pulse at said first voltage level is being received from the oscillator means and to switch the signal at the second input to its output when a pulse at said second voltage level is being received from the oscillator means, low pass filter means connected to the output of the switching means for producing a first constant voltage when first and second series of electrical pulses are being applied to the switching means, and for producing a second constant voltage when first and second series of electrical pulses are not being applied to the switching means, reference means for producing a first reference voltage between said first and second constant voltages, and comparator means coupled to the low pass filter means, the reference means, and to said logic means and operable to produce said first output condition during the presence of a voltage from the low pass filter means which differs from said first reference voltage in the direction of said first constant voltage and to produce said second output condition during the presence of a voltage from the low pass filter means which differs from said first reference voltage in the direction of said second constant voltage; and the synchronous detector means of the other of said receiver means includes switching means coupled to the oscillator means and having first and second inputs connected to the outputs of the first and second buffer means of the circuit means of said other of said receiver means, said switching means being operable to switch the signal at the first input to its output when a pulse of said second voltage level is being received from the oscillator means and to switch the signal at the second input to its output when a pulse at said first voltage level is being received from the oscillator means, low pass filter means connected to the output of the switching means for producing a third constant voltage when first and second series of electrical pulses are being applied to the switching means, and for producing said second constant voltage when first and second series of electrical pulses are not being applied to the switching means, reference means for producing a second reference voltage between said second and third constant voltages, and comparator means coupled to the low pass filter means, the reference means, and to said logic means and operable to produce said first output condition during the presence of a voltage from the low pass filter means which differs from said second reference voltage in the direction of said third constant voltage and to produce said second output condition during the presence of a voltage from the low pass filter means which differs from the second reference voltage in the direction of said second constant voltage.

8. Sensing apparatus in accordance with claim 7 including output means coupled to said logic means and operable to produce a momentary signal at a first output terminal in response to said logic means switching from said second operating state to said first operating state and operable to produce a momentary signal at a second output terminal in response to said logic means switching from said first operating state to said second operating state whereby passage of an object through the portal in the one direction causes the output means to produce a momentary signal at said second output terminal and passage of an object through the portal in the opposite direction causes the output means to produce a momentary signal at said first output terminal.

9. Sensing apparatus in accordance with claim 8 wherein said logic means includes first bistable means connected to the comparator means of said first and second receiver means and having first and second output conditions, said first bistable means being set to produce said first output condition in response to the comparator means of said first receiver means producing said second output condition while the comparator means of said second receiver means is producing its first output condition and being set to produce said second output condition in response to the comparator means of said second receiver means producing said second output condition while the comparator means of said first receiver means is producing its first output condition; and second bistable means connected to the first bistable means and operable to be switched to a first operating state in response to a clock pulse when the first bistable means is producing the first output condition and operable to be switched to a second operating state in response to a clock pulse when the first bistable means is producing the second output condition whereby passage of an object through the portal in the one direction causes the second bistable means to be switched to its second operating state in response to a clock pulse and passage of an object through the portal in the opposite direction causes the second bistable means to be switched to its first operating state in response to a clock pulse.

* * * * *